US005833558A

United States Patent [19]

Pettle

[11] Patent Number: 5,833,558

[45] Date of Patent: Nov. 10, 1998

[54] METHOD OF LIGHTING A BASKETBALL GOAL, AN APPARATUS THEREOF, AND A KIT THEREFOR

[76] Inventor: Gerry Pettle, 160 Elgin Mills Road West, Richmond Hill Ontario, Canada, L4C 4M2

[21] Appl. No.: 637,391

[22] Filed: Apr. 25, 1996

[51] Int. Cl.[6] ..... A63B 63/08

[52] U.S. Cl. ..... 473/479; 473/485

[58] Field of Search ..... 473/472, 479, 473/480, 485, 488, 489

[56] References Cited

U.S. PATENT DOCUMENTS 5,403,000 4/1995 Woosley ..... 473/485 X

*Primary Examiner*—William H. Grieb

[57] ABSTRACT

A lighted basketball goal encompassing a lighted flexible member situated about the perimeter of the basketball rim. This lighted flexible member is situated at a predetermined position so as not to interfere with the basketball, and so as not to be jarred or damaged by said basketball. The power supply coupling to the flexible lighting element is further characterized by a quick connect mechanism. A method for lighting an existing basketball goal comprising the installation of a flexible lighted member about the perimeter of a basketball rim at a predetermined position as not to interfere with the basketball, or be jarred or damaged by said basketball.

11 Claims, 7 Drawing Sheets

METHOD OF LIGHTING A BASKETBALL GOAL, AN APPARATUS THEREOF, AND A KIT THEREFOR

FIELD OF THE INVENTION

This invention relates to a method of lighting a basketball goal, an apparatus thereof and a kit of components therefor. This invention finds particular application for existing basketball goals installed at the residences of basketball enthusiasts.

BACKGROUND OF INVENTION

It is known to provide a basketball goal that is designed with integral lighting therewith when first purchased. Examples of such devices are found in prior patent documents.

A rope light is distributed by W.A.C. Lighting Company of College Point, N.Y. among others. Their brochure indicates that the lights are strung at approximately 1" intervals, and that the lengths of rope may be cut at only certain locations and specifically after 18 bulbs in series. Then, the appropriate connector is placed at each end. The W.A.C. Lighting Company instruction sheet also refers to utilizing fasteners which may be used to secure the rope light to a surface or fence.

U.S. Pat. No. 4,984,787 and U.S. Pat. No. 5,305,998, both to Nesbit, issued on Jan. 15, 1991 and Apr. 26, 1994 respectively and teach a lighted basketball rim, with lighting extending in the rim. In one particular embodiment, the lights extend through the rim as best seen in FIG. 5, wherein the rim is transparent and obviously lights up according to the circuitry shown. In another embodiment of the same patent, there is shown a wire hoop with slots in it to allow the light to pass through the slots. In all embodiments, the combination rim must stand up to the impact of a basketball and constant impact may effect the reliability of this structure over time. Slam dunking shots with players hanging from the rim may also impact the life expectancy of the goal.

U.S. Pat. No. 5,346,207 refers to an illuminated back board, but not the rim itself.

U.S. Pat. No. 4,991,837 issued in 1991 to Deal describes a basketball hoop visual guide which is mounted below the rim as best seen in FIG. 4. Nowhere within the reference is there any hint that the visual guide may be illuminated.

U.S. Pat. No. 5,263,209 issued in 1993 to Pattee describes a night light for a toilet.

However, none of the above-mentioned patents describes a method of lighting an existing basketball goal. For example, one may have a basketball goal installed above the garage of a home. Alternatively, a post may be anchored in the ground near the front of the property wherein a basketball goal and backboard are provided. Those using the standard basketball goal which is typically not lit would therefore be limited to the hours of play of the light available during the daytime unless the driveway or property of the homeowner is well lit with flood lights or the like.

Nowhere within the prior art is there found a method of lighting an unlit basketball goal which includes the steps of installing a flexible lighting member about the perimeter of the basketball rim at a predetermined position so as not to interfere with the basketball and so as not to be jarred or damaged by the basketball. The components are also provided to carry out such a method in a kit form to light a previously unlit basketball goal.

It is therefore a primary object of this invention to provide a method of lighting a previously unlit basketball goal.

It is a further object of this invention to light the aforementioned goal in an economical manner.

It is a further object of this invention to light the basketball goal with a flexible lighting member that does not interfere with the basketball when installed on the goal and which will not easily be dislodged from its preferred position.

Further and other objects of the invention will become apparent to those skilled in the art when considering the following summary of the invention and the more detailed description of the preferred embodiments illustrated herein.

SUMMARY OF INVENTION

According to a primary aspect of the invention, there is provided a basketball goal having a top and bottom, said goal being affixed in use to a surface which may be utilized as a backboard, said goal comprising a rim portion having a top and a bottom, said rim portion having a flange portion having sides for affixing said goal to said surface utilized as a backboard, said rim portion having disposed proximate the bottom thereof, a plurality of net engaging portions, said net engaging portions extending generally away from the bottom of said rim and being disposed preferably substantially equidistant from one another about the circumference of said rim, said net engaging portions for supporting the net of the basketball goal, said basketball goal having a net provided therewith, in use, said net having a top and a bottom and having disposed proximate its top a plurality of loop portions which engage with the plurality of net engaging portions disposed with the rim of said basketball goal, said goal including a flexible lighting member being affixed to the net engaging portions preferably substantially adjacent said loop portions of said net, said flexible lighting member being disposed proximate the bottom of the rim, and extending substantially adjacent the circumference of the basketball rim from proximate the flange portion at one side thereof to proximate the flange portion at the other side thereof, said lighting member having disposed proximate one side of the flange portions a power supply element (and preferably a quick connect having a male and female portion disposed on either of the flexible lighting member or the power supply element so as to provide a source of power for said flexible lighting member), preferably said flexible lighting member including an array of lighting elements (preferably 54) encased in a flexible PVC (polyvinyl chloride) sheath being of 54" in length so as to extend generally about the circumference of a 55" basketball rim and having disposed at one end an end cap and at the other end thereof a compatible male/female connector to be coupled with the power supply cord, said power supply cord to be plugged into or wired into a supply of current, whereby the basketball rim is fully lit for night use and wherein said lighting member is positioned away from the rim so as not to be damaged by the impact of a basketball engaging against a rim to be either broken or dislodged thereby or alternatively so as not to interfere with the passage of the basketball through the basketball goal.

According to another aspect of the invention, there is provided a kit of components to convert a standard basketball goal which is unlit to one which is capable of being utilized after dark, said kit of components comprising a flexible lighting member, generally flat broad-based fasteners, a power supply cord, and in one embodiment a basketball goal having a net including loop portions and a rim and a mounting flange having sides, said rim having net supporting portions provided therewith, said flexible lighting member when installed on the goal extending substantially adjacent the perimeter of the basketball rim from the side of the mounting flange to proximate the other side of the mounting flange just beneath and just outside of said rim, said fasteners in use for engaging the net supporting portions of the basketball rim and also for engaging the loop portions of the basketball net which engage the net supporting portions, said fastener in use extending around said flexible lighting member proximate each of said net supporting members of said rim and loop portions of said net so as to fully capture said members and said loops when fastened about the perimeter of said flexible member to thereby secure said flexible member at that predetermined position in use, the flexible member in use engaged with said power supply to energize the flexible member in use once the flexible member is fastened to the basketball rim, preferably said power supply and flexible member including compatible male/female connectors and providing a coupling to ensure that the members do not easily dislodge in use, whereby said kit of components may be used to convert a previously unlit basketball goal to night use.

According to yet another aspect of the invention, there is provided a method of converting a basketball goal which is unlit to one which may be used after dark, said basketball goal including a rim portion, a net portion, and a goal mounting portion for mounting the goal adjacent a backboard surface, said rim portion having a top and bottom and having disposed proximate the bottom thereof net engaging portions, said basketball net having a top and bottom and having disposed proximate the top thereof loops for engaging the net engaging portion of the rim, said method comprising:

(1) obtaining a flexible lighting member of predetermined length (and preferably 54" so as to extend substantially about the perimeter of a 55" basketball rim), said flexible member preferably being an array of lighting elements, such as LEDs or the like, sheathed in a resilient thermoplastic material (preferably PVC) and having disposed proximate one end thereof an end cap and having disposed proximate the other end thereof a male/female connecting portion, (2) obtaining suitable, preferably flat, preferably strap-like fasteners, preferably having disposed proximate one end thereof a self-locking portion and having disposed at the free end thereof a leading end, preferably having cleats compatible with said self-locking portion, (3) positioning said flexible lighting member proximate the net engaging portions of said basketball rim adjacent the bottom of the rim and adjacent the top of the loop elements of the net, (4) passing the fastening element proximate the leading end thereof about the basketball net loop, the flexible lighting element, and the net supporting member so as to capture these aforementioned items within a loop defined by said fastener and preferably wherein the leading end is passed through the self-locking portion so as to capture these elements, (5) pulling on said fastening portion so as to ensure that the flexible lighting element is snugly retained and fastened, and preferably by the cleat engaging the self-locking portion, (6) preferably cutting off the lead end of the leading element so as to ensure that no loose ends are present, (7) repeating the fastening of the flexible lighting member in the same manner as the above steps proximate a substantial number of or all of said net supporting members and loops so as to ensure that the flexible lighting member is disposed in the correct position proximate that predetermined location so as to not interfere with the passage of the basketball through the basketball goal and further not to be dislodged by the impact of the basketball on the goal, (8) affixing a power supply to the end of the flexible member, preferably with a compatible male/female connector and in one example including a coupling to ensure the firm securement thereat, whereby in carrying out said method said unlit basketball goal may be lit for use after dark.

DETAILED DESCRIPTION OF THE PREFERRED EMBODIMENTS

Figure 3:
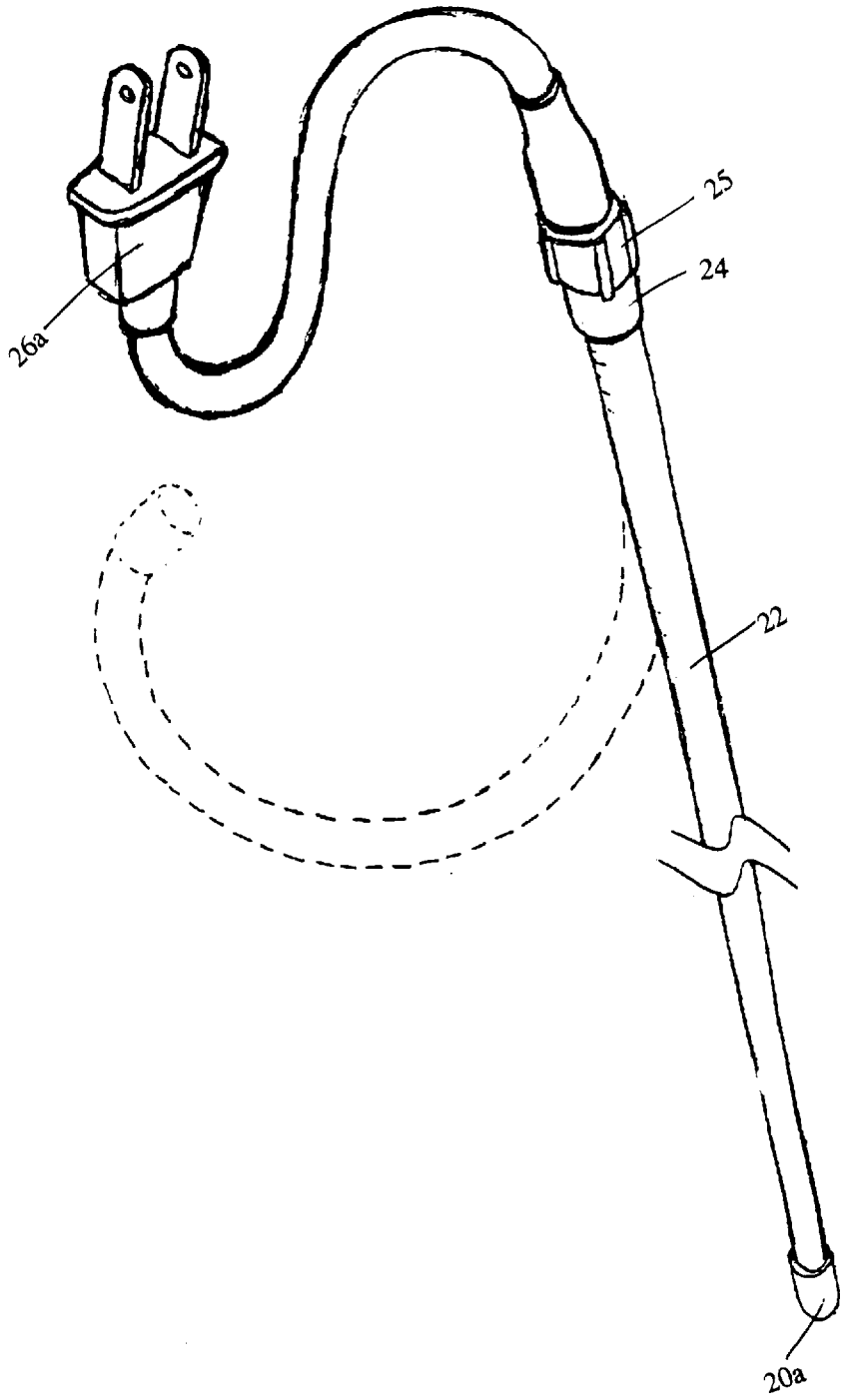
FIG. 3 is a view of the lighting member component of this invention.

Referring generally to the Figures, there is illustrated a basketball goal utilized both during the day hours and after dark. A kit of elements is therefore provided in order to convert a standard basketball goal normally installed on a backboard to a lit goal for play after dark. The kit includes a flexible lighting member as best seen in FIG. 3, which is secured to adjacent the rim 10 of the goal 5 proximate the net supporting members 11 of the goal 5.

Figure 1:
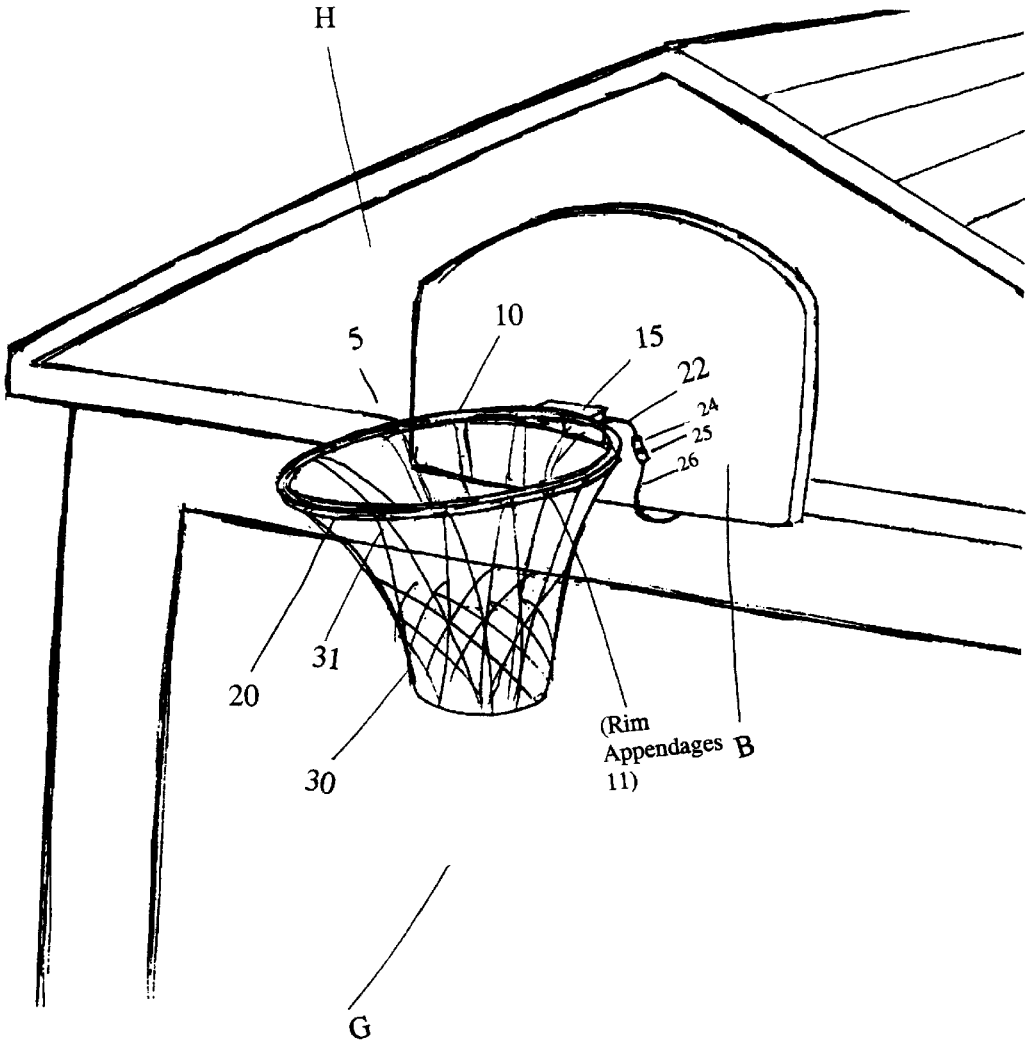
FIG. 1 is a front perspective showing the basketball hoop apparatus incorporating the one preferred embodiment of the present invention.

Referring now to FIG. 1 there is illustrated a basketball goal 5 being mounted to a backboard B above a garage G for a home H. This is found in many typical suburban homes. Alternatively, the backboard B may be affixed to a pole set in the ground or, alternatively fixed to a moveable stand. Typically, such a basketball goal 5 is available for use primarily during the day light hours but also depending on flood light, for use after dark. However, depending on the power of the flood lighting the basketball rim is often difficult to focus after dark from distances greater than approximately 6 feet. It is therefore difficult for the individual to practice typical shots such as foul shots, three point shots or other shots originating outside the area known as the key.

Figure 4:
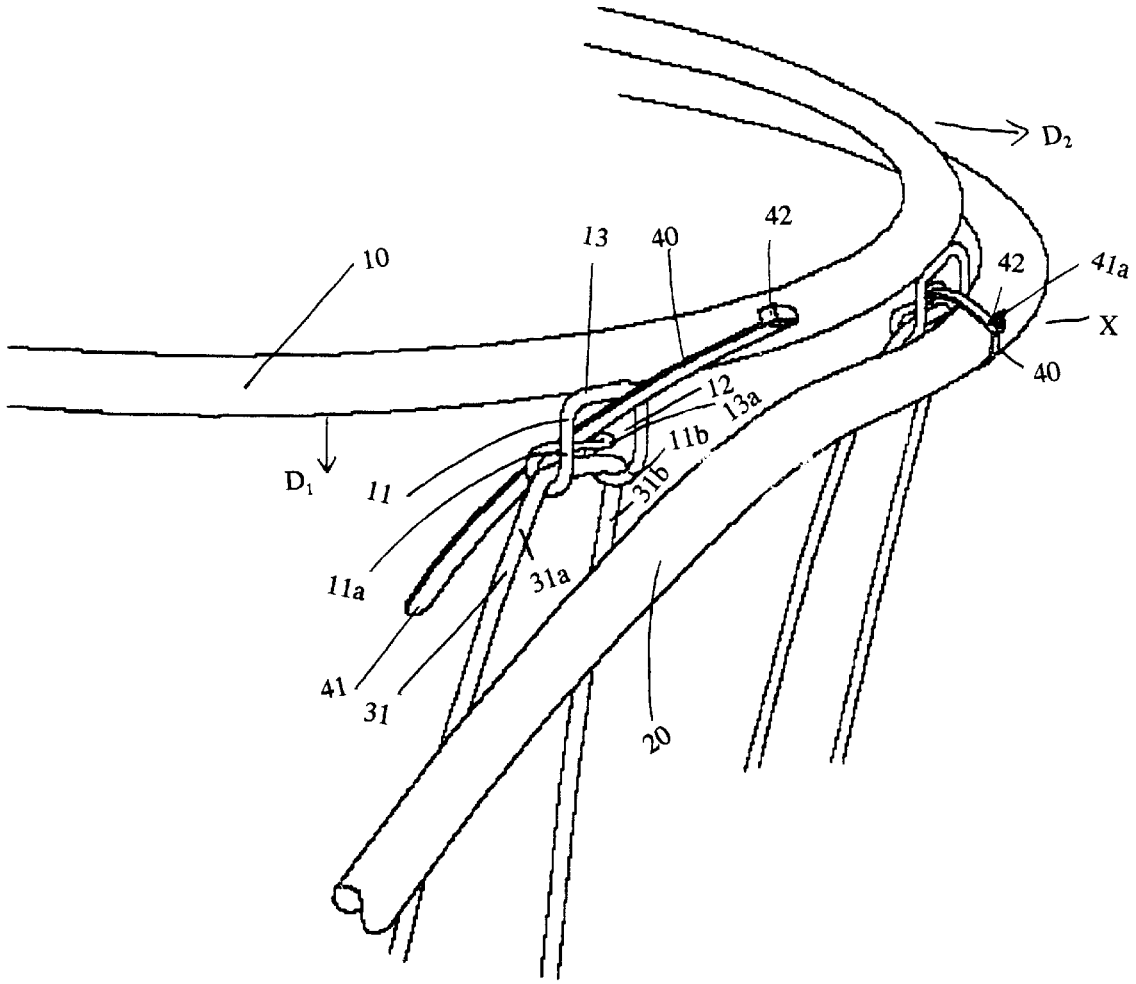
FIG. 4 is an enlarged sectional view illustrating the preferred mode of fastening and attachment of the lighting member to the basketball rim.
Figure 5:
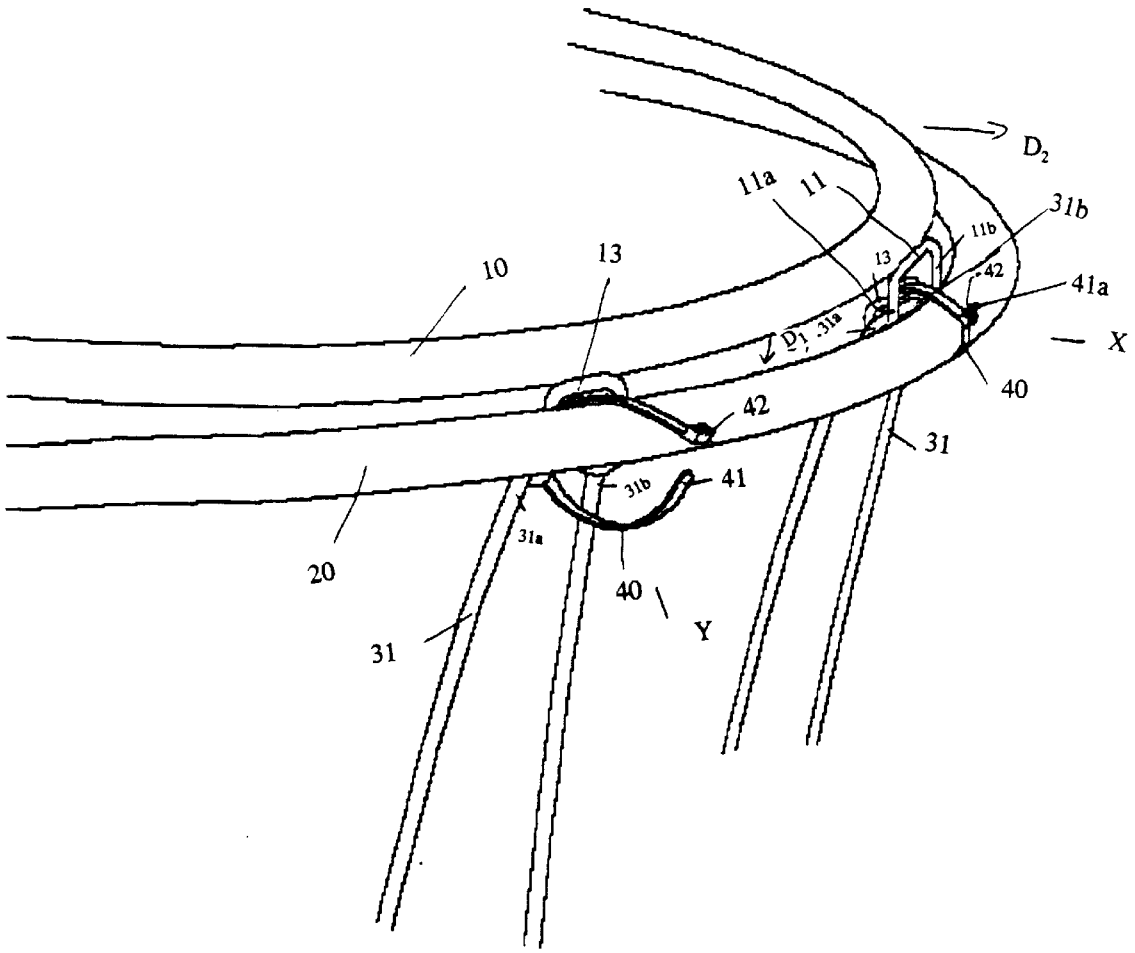
FIG. 5 is an enlarged sectional view further illustrating the preferred mode of fastening and attachment of the lighting member to the basketball rim.
Figure 6:
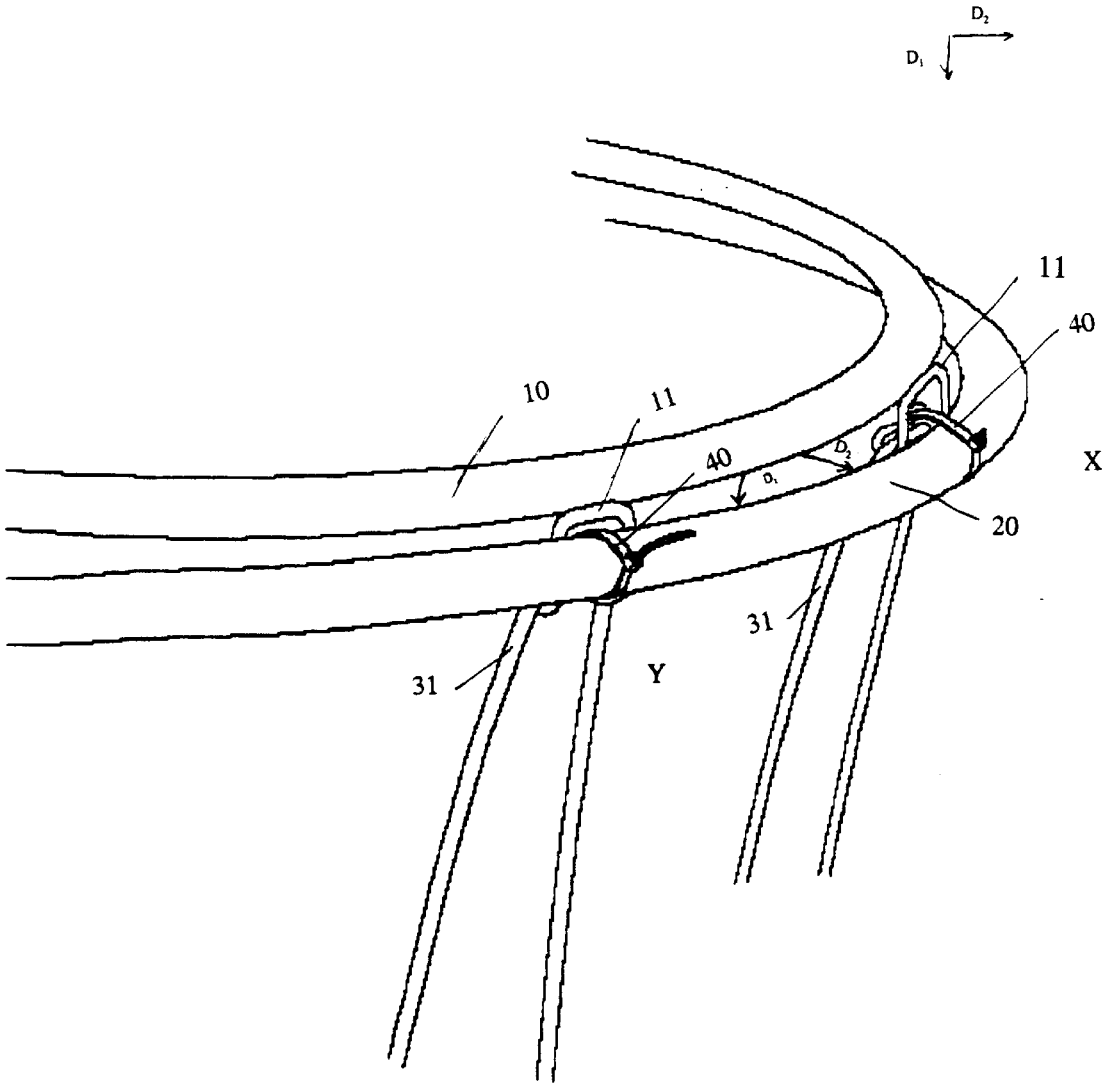
FIG. 6 is an enlarged sectional view further illustrating the preferred mode of fastening and attachment of the lighting member to the basketball rim.

In order to therefore rectify this situation, a lighting element 20 is attached to the basketball goal at predetermined locations just outside of the circumference of the basketball rim 10 and just below the bottom of said rim 10 adjacent to the net supporting portions 11. As best seen in FIGS. 4 to 6 the lighting element 20 is therefore fixed in position adjacent the rim 10 of the basketball goal 5 in such a manner so as not to interfere with the path of the basketball as it enters the goal 5 or as it passes through the net 30. Net 30 is supported to the net supporting portions 11 via loops 31. Since the lighting element 20 when fastened in position does not interfere with the basketball path through the goal 5 because of the positioning of the lighting element 20, there is reduced possibility of damaging the lighting element. Since the ball is traveling in a downward path, the ball will typically hit the lighting element as it descends toward the goal, only if a shot has completely missed the goal, originates from directly below the net, or as a result of bouncing the ball directly underneath the net or off a player. Typically the basketball is shot to the net in an arc and therefore under most circumstances except for those mentioned above the lighting element will not be impacted by the ball. In any event, the lighting element is provided as a flexible lighting element made up of rugged components so as to withstand much of the typical abuse.

The more likely force upon the lighting element tending to jar the lighting element would be those individuals capable of dunking a basketball and afterwards hanging on to the rim. It is therefore important that the lighting element be well secured to the basketball rim 10.

The lighting element is also connected to a power cord 26 at coupling elements 24, 25, at power supply extension 22. This power supply 26 may extend directly into a panel or may alternatively be plugged into a garage outlet. Once powered through either a switch or a plug, the basketball goal 5 may be lit in the after dark time period so as to provide a ring of light below the rim 10 which any individual can focus upon in order to help guide the basketball into the goal 5. As the basketball falls into the goal 5 past the rim 10 and into the net portion 30, it will at no time engage the flexible lighting element 20.

Figure 2:
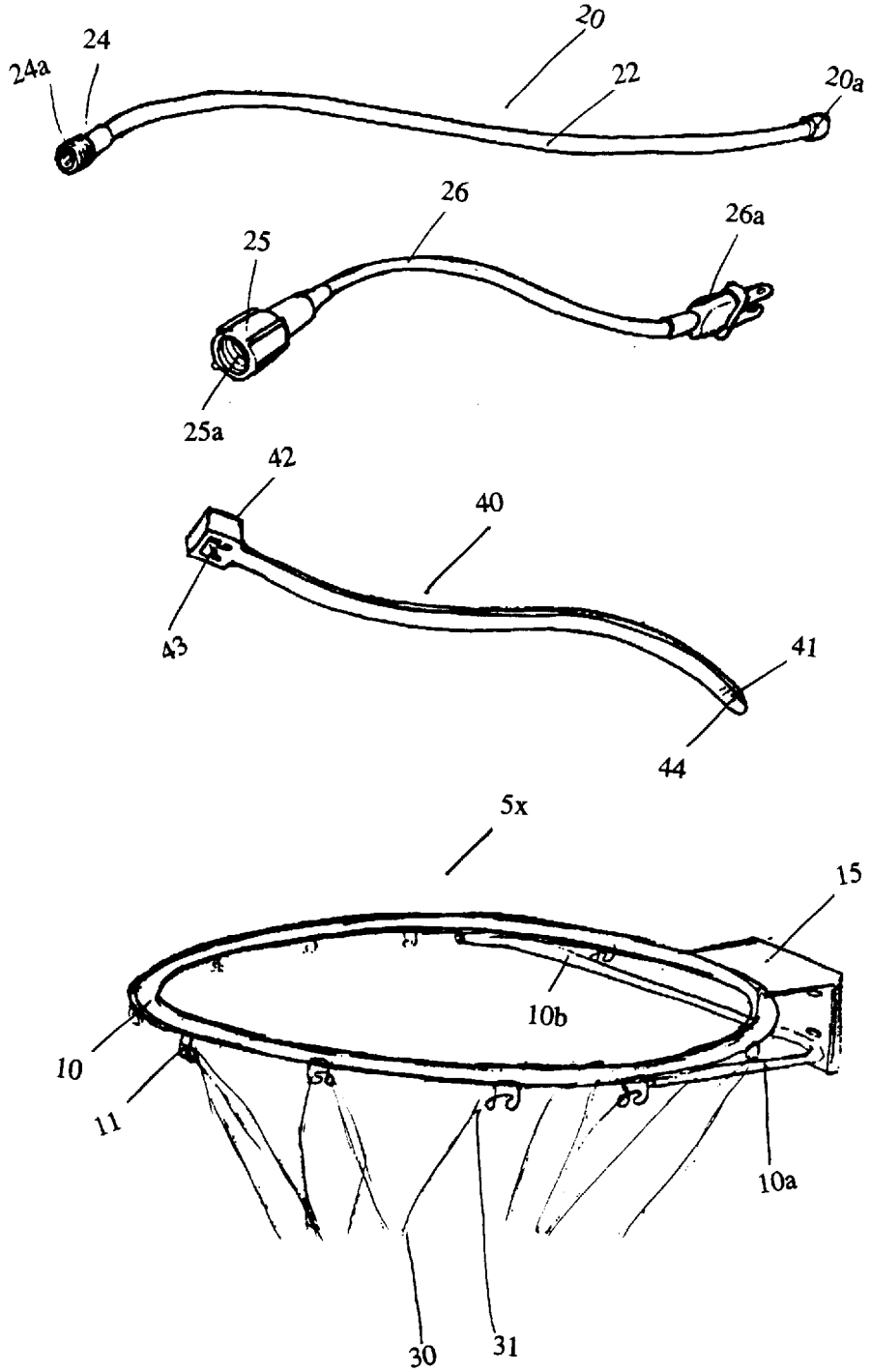
FIG. 2 is a view of the components utilized in the conversion of an unlit to a lit basketball goal, such as the preferred embodiment illustrated in FIG. 1.

Referring specifically to FIGS. 2 and 3 there is illustrated a kit of components including a flexible lighting element 20, a power supply cord 26, a contacting strap 40, and a typical basketball goal 5X. The flexible lighting element is as supplied by Wide Loyal Lighting Company Ltd. and their PVC systems which include sub-miniature light bulbs encased in PVC or other flexible material. The lights may be of any desired colour. Typically, the light is supplied in rolls with cutting demarcations at predetermined locations. An end cap is provided to cap off the blunt end of the "rope light" at 20A. At the other end of the flexible lighting element 20 is a threaded coupling portion 24 threaded at portion 24A. The power supply 26 has a mating female coupling 25 threaded within its internal diameter at 25A. A plug 26A is provided as is well known. Alternatively, the flexible lighting member may be supplied by Magic Light Limited as distributed by W.A.C. Lighting Company of College Point, N.Y. The power supply is consistent with 120V for the flexible element or "rope light". Typically, 5.1 watts of power are required per foot over the 54" recommended length of the rope light to be installed on the basketball hoop 5X. The bulbs are disposed within the flexible lighting member at 1" intervals approximately, creating a total of 54 bulbs in 54 inches housed in a solid core flexible PVC clear tubing of approximately ½" in diameter. The power cord is approximately 1' in length.

The connector 40 therefore provided to fasten the flexible member to the basketball goal 5X is preferably marked as BURNDY as supplied by RAAK of 145 Church Street, Toronto, Ontario. The connector has two ends. At one end is a female connecting portion 42 having therein disposed a one-way cleat 43 within the opening through which the lead end 41 is inserted as best seen in relation to FIGS. 4 and 5. Disposed adjacent the lead end 41 are a number of tooth-like portions along the bottom side of the fastening element 40. When the lead end 41 is inserted into the opening wherein the cleat 43 is disposed, pulling on the fastener will lock the cleat at the various detent locations of the strap best suited for the diameter of the lighting element 20 being secured. This type of fastener is well known and is used typically as an electrical fastener. The basketball goal provided is typically one which includes a rim portion 10 having net supporting portions 11, being a total of 12 portions, disposed equidistantly around the circumference of the rim 10 at members 11. The net 30 is fixed through these loop-like net supporting members 11 which includes a top horizontal wire portion 13 extending to side leg portions 11A and 11B and a lower horizontally disposed wire portion 13A. A saddle-like opening is therefore provided between the wire portions 13 and 13A and the side portions 11A and 11B of the net supporting member 11 wherein the loop portion 31 of the net 30 extends. Reinforcing portions 10A and 10B extend from the fastening flange 15 of the basketball goal 5X to the rim 10 as is well known.

Referring now to FIGS. 4, 5 and 6, there is described the method and procedure for fastening the lighting member 20 adjacent to the basketball rim 10 with the kit of components as described in relation to FIGS. 2 and 3. The lighting member provided and as described above, the preferred rope light, is of 54" in extension, not including the power cord which is approximately another 12". Therefore, the entire unit when assembled is approximately 64". It is important to extend the lighting member around the rim 10 so that the power cord 26 is disposed in the position as best seen in relation to FIG. 1. It has been determined that by extending the "rope light" about the rim 10 of the basketball goal 5 adjacent the net supporting elements 11, proximate the wire portions 11A and 11B with the exterior of the ½" diameter rope light 20 engaging against the substantially vertical legs 11A and 11B of the net supporting element 11, that the rope light 20 will, when installed, as best seen in relation to FIG. 6, be disposed a predetermined amount D2 horizontally away from the perimeter of the rim and a predetermined distance D1 vertically downwardly away from the plain in which the rim extends. By fastening therefor the lighting element 20 in this position adjacent the net supporting elements 11, a basketball will not be disturbed in its flight path by the lighting element, and conversely the lighting element will seldom be impacted by a basketball.

The lighting element 20 therefore is affixed at each of the 12 net supporting locations 11 by passing the fastener 40 as seen in FIGS. 4, 5 and 6 through the opening 12 created by the wire rod portion 11 around the saddle portion created by the substantially horizontally extending wire portion 13A of the net supporting element 11, capturing the net loop 31 defined between the net portions 31A and 31B and engaging therefore the portion 41 of the fastener 40 into the receiving end of 42 of said fastener 40, wherein the lead end 41 may be pulled up so that the cleat portion 43 engages the most appropriate detent 44. The tail end 41 is clipped to the shorter trimmed lead portion 41A as seen in FIGS. 4 and 5. Thereby, the lighting element 20 is fastened at that particular location. This procedure is repeated for all of the twelve locations and for a portion of the power cord if desired. FIG. 6 illustrates two typical locations wherein the lighting element 20 captures the loop portion 31 and the portion 13A of the net retaining portion 11 at such a position so as not to interfere with the net 30 or the rim 10. As mentioned previously, one would have to shoot from directly below the basket to jar the lighting element 20 at its preferred location.

Alternatively, the lighting element 20 may be molded from one continuous predefined section of flexible material formed as a loop, and fastened in position in the same manner.

Figure 7:
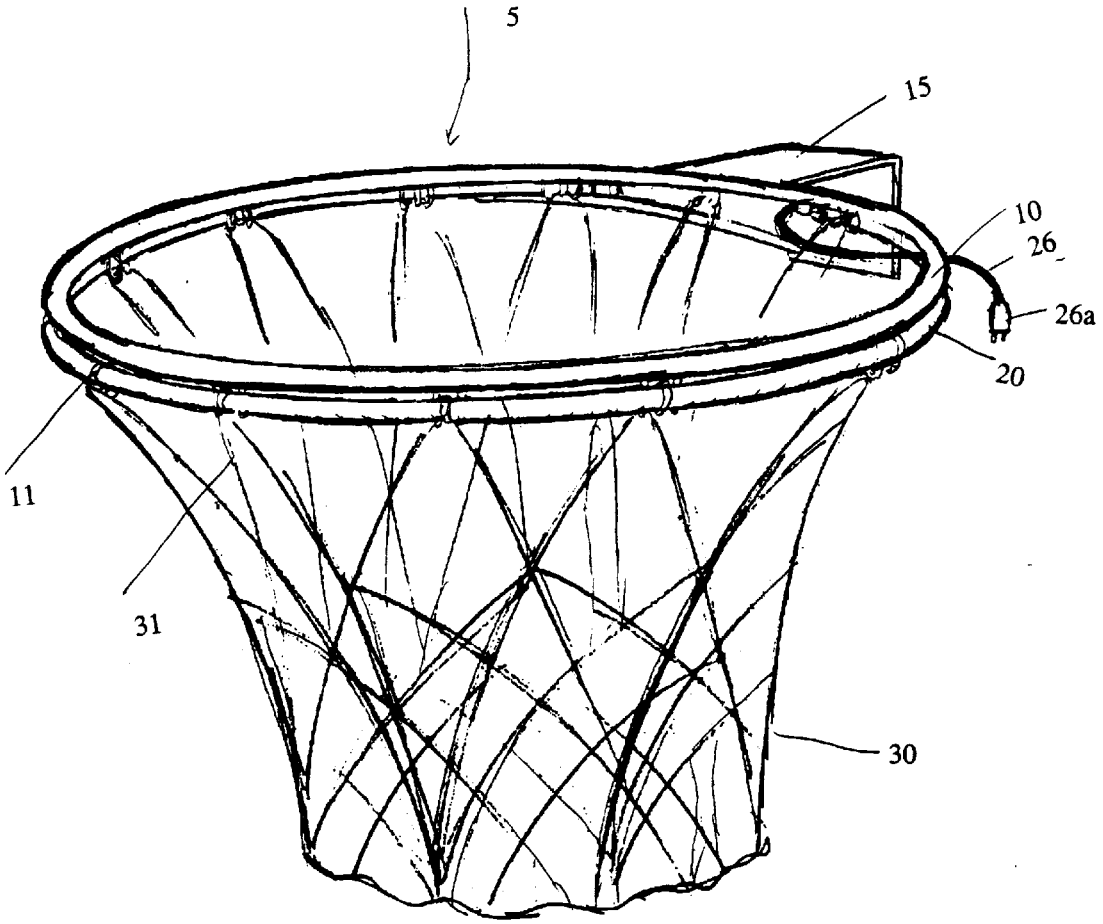
FIG. 7 is an enlarged perspective view showing the lighting element attached to the basketball hoop in a preferred embodiment of the present invention.

The final basketball goal 5 as illustrated in FIG. 7 may therefore be sold as a basketball goal which may be sold as seen in FIG. 5 as a complete unit. The kit of components as illustrated in FIG. 2 may also be sold with or without the basketball goal 5X along with a set of instructions as to how to install the lighting element at its correct location as described in relation FIGS. 4 through 6.

As many changes can be made to the invention without departing from the scope of the invention; it is intended that all material contained herein be interpreted as illustrative of the invention and not in a limiting sense.

The embodiments of the invention in which an exclusive property of privilege is claimed are as follow:

1. A basketball goal having a top and bottom, said goal being affixed in use to a surface which may be utilized as a backboard, said goal comprising a rim portion having a top and a bottom, said rim portion having a flange portion having sides for affixing said goal to said surface utilized as a backboard, said rim portion having disposed proximate the bottom thereof, a plurality of net engaging portions, said net engaging portions extending generally away from the bottom of said rim and being disposed from one another about the circumference of said rim, said net engaging portions for supporting the net of the basketball goal, said basketball goal having a net provided therewith, in use, said net having a top and a bottom and having disposed proximate its top a plurality of loop portions which engage with the plurality of net engaging portions disposed with the rim of said basketball goal, said goal including a flexible lighting member being affixed to the net engaging portions adjacent to said loop portions of said net, said flexible lighting member being disposed proximate the bottom of the rim, and extending substantially adjacent the circumference of the basketball rim from proximate the flange portion at one side thereof to proximate the flange portion at the other side thereof, said lighting member having disposed proximate one side of the flange portions a power supply element whereby the basketball rim is fully lit for night use and wherein said power supply for said lighting element further comprises a quick connect having a male and female portion disposed on either of the flexible lighting member or the power supply element so as to provide a source of power for said flexible lighting member and wherein said lighting member is positioned away from the rim so as not to be damaged by the impact of a basketball engaging against a rim to be either broken or dislodged thereby, and so as not to interfere with the passage of the basketball through the basketball goal.

2. A basketball goal having a top and bottom, said goal being affixed in use to a surface which may be utilized as a backboard, said goal comprising a rim portion having a top and a bottom, said rim portion having a flange portion having sides for affixing said goal to said surface utilized as a backboard, said rim portion having disposed proximate the bottom thereof, a plurality of net engaging portions, said net engaging portions extending generally away from the bottom of said rim and being disposed from one another about the circumference of said rim, said net engaging portions for supporting the net of the basketball goal, said basketball goal having a net provided therewith, in use, said net having a top and a bottom and having disposed proximate its top a plurality of loop portions which engage with the plurality of net engaging portions disposed with the rim of said basketball goal, said goal including a flexible lighting member being affixed to the net engaging portions adjacent to said loop portions of said net, said flexible lighting member being disposed proximate the bottom of the rim, and extending substantially adjacent the circumference of the basketball rim from proximate the flange portion at one side thereof to proximate the flange portion at the other side thereof, said lighting member having disposed proximate one side of the flange portions a power supply element whereby the basketball rim is fully lit for night use and wherein said flexible lighting member including an array of lighting elements encased in a flexible PVC (polyvinyl chloride) sheath being of substantially 54" in length so as to extend generally about the circumference of a 55" basketball rim and having disposed at one end an end cap and at the other end thereof a compatible male/female connector to be coupled with the power supply cord, said power supply cord to be plugged into or wired into a supply of current and wherein said lighting member is positioned away from the rim so as not to be damaged by the impact of a basketball engaging against a rim to be either broken or dislodged thereby, and so as not to interfere with the passage of the basketball through the basketball goal.

3. A kit of components to convert a standard basketball goal which is unlit to one which is capable of being utilized after dark, said basketball goal having a net including loop portions and a rim and a mounting flange having sides, said rim having net supporting portions provided therewith, said kit of components comprising a flexible lighting member, generally flat broad-based fasteners, and a power supply cord, said flexible lighting member when installed on the goal extending substantially adjacent the perimeter of the basketball rim from the side of the mounting flange to proximate the other side of the mounting flange just beneath and just outside of said rim, said fasteners in use for engaging the net supporting portions of the basketball rim and also for engaging the loop portions of the basketball net which engage the net supporting portions, said fastener in use extending around said flexible lighting member proximate each of said net supporting members of said rim and loop portions of said net so as to fully capture said members and said loops when fastened about the perimeter of said flexible member to thereby secure said flexible member at that predetermined position in use, the flexible member in use engaged with said power supply to energize the flexible member in use once the flexible member is fastened to the basketball rim, whereby said kit of components may be used to convert a previously unlit basketball goal to night use.

4. The kit of components of claim 3 wherein said power supply and flexible member including compatible male/female connectors and providing a coupling to ensure that the members do not easily dislodge in use.

5. A kit of components to convert a standard basketball goal which is unlit to one which is capable of being utilized after dark, said kit of components comprising a flexible lighting member, generally flat broad-based fasteners, a power supply cord, and a basketball goal having a net including loop portions and a rim and a mounting flange having sides, said rim having net supporting portions provided therewith, said flexible lighting member when installed on the goal extending substantially adjacent the perimeter of the basketball rim from the side of the mounting flange to proximate the other side of the mounting flange just beneath and just outside of said rim, said fasteners in use for engaging the net supporting portions of the basketball rim and also for engaging the loop portions of the basketball net which engage the net supporting portions, said fastener in use extending around said flexible lighting member proximate each of said net supporting members of said rim and loop portions of said net so as to fully capture said members and said loops when fastened about the perimeter of said flexible member to thereby secure said flexible member at that predetermined position in use, the flexible member in use engaged with said power supply to energize the flexible member in use once the flexible member is fastened to the basketball rim, whereby said kit of components may be used to convert a previously unlit basketball goal to night use.

6. A method of converting a basketball goal which is unlit to one which may be used after dark, said basketball goal including a rim portion, a net portion, and a goal mounting portion for mounting the goal adjacent a backboard surface, said rim portion having a top and bottom and having disposed proximate the bottom thereof net engaging portions, said basketball net having a top and bottom and having disposed proximate the top thereof loops for engaging the net engaging portion of the rim, said method comprising:

(1) obtaining a flexible lighting member of predetermined length said flexible member being an array of lighting elements sheathed in a resilient thermoplastic material and having disposed proximate one end thereof an end cap and having disposed proximate the other end thereof a male/female connection portion, (2) obtaining suitable fasteners, (3) positioning said flexible lighting member proximate the net engaging portions of said basketball rim adjacent the bottom of the rim and adjacent the top of the loop elements of the net, (4) passing the fastening element proximate the leading end thereof about the basketball net loop, the flexible lighting element, and the net supporting member so as to capture these aforementioned items within a loop defined by said fastener so as to capture these elements, (5) pulling on said fastening portion so as to ensure that the flexible lighting element is snugly retained and fastened, (6) repeating the fastening of the flexible lighting member in the same manner as the above steps proximate a substantial number of or all of said net supporting members and loops so as to ensure that the flexible lighting member is disposed in the correct position proximate that predetermined location so as to not to interfere with the passage of the basketball through the basketball goal and further not to be dislodged by the impact of the basketball on the goal, (7) affixing a power supply to the end of the flexible member, whereby in carrying out said method said unlit basketball goal may be lit for use after dark.

7. The method of claim 6 wherein said flexible lighting member is substantially 54" so as to extend substantially about the perimeter of a 55" basketball rim.

8. The method of claim 6 wherein said flexible lighting member is made from PVC.

9. The method of claim 6 wherein said fastener is a flat strap-like element having disposed proximate one end thereof a self-locking portion and having disposed at the free end thereof a leading end having cleats compatible with said self-locking portion wherein the leading end is passed through the self-locking portion to provide locking by the cleat engaging the self-locking portion.

10. The method of claim 9 further comprising the step of cutting off the lead end of the leading element so as to ensure that no loose ends are present.

11. The method of claim 6 wherein said power supply is connected to the flexible lighting element by a compatible male/female connector including a coupling to ensure the firm securement thereof.

* * * * *